US005733111A

United States Patent [19]

Yu et al.

[11] Patent Number: 5,733,111

[45] Date of Patent: Mar. 31, 1998

[54] GEROTOR PUMP HAVING INLET AND OUTLET RELIEF PORTS

[75] Inventors: Dequan Yu, Ann Arbor, Mich.; Gerard Cronin, Cologne; Ronald Engel, Frechen, both of Germany

[73] Assignee: Ford Global Technologies, Inc., Dearborn, Mich.

[21] Appl. No.: 753,815

[22] Filed: Dec. 2, 1996

[51] Int. Cl.[6] ..... F04C 2/10

[52] U.S. Cl. ..... 418/78; 418/171; 418/189

[58] Field of Search ..... 418/75, 78, 166, 418/171, 189

[56] References Cited

U.S. PATENT DOCUMENTS

| | | | |
|---|---|---|---|
| 1,129,090 | 2/1915 | Hawley | 418/189 |
| 2,870,720 | 1/1959 | Lorenz | 418/189 |
| 2,884,864 | 5/1959 | Bobnar | 418/189 |
| 2,990,783 | 7/1961 | Oliver | 418/132 |
| 3,034,448 | 5/1962 | Brundage | 418/189 |
| 3,130,682 | 4/1964 | Meads | 418/189 |
| 3,267,862 | 8/1966 | Mosbacher | 418/189 |
| 3,303,792 | 2/1967 | Littlewood | 418/189 |
| 3,995,978 | 12/1976 | Khan et al. | 418/171 |
| 4,008,018 | 2/1977 | McDermott | 418/171 |
| 4,290,739 | 9/1981 | Korse | 418/189 |
| 4,767,296 | 8/1988 | Satomoto et al. | 418/171 |

FOREIGN PATENT DOCUMENTS

| | | | |
|---|---|---|---|
| 61-61993 | 3/1986 | Japan | 418/171 |
| 62-282185 | 12/1987 | Japan | 418/78 |
| 2-191887 | 7/1990 | Japan | 418/171 |
| 197865 | 5/1923 | United Kingdom | 418/189 |

*Primary Examiner*—John J. Vrablik
*Attorney, Agent, or Firm*—Neil P. Ferraro

[57] ABSTRACT

A gerotor pump includes a pair of relief ports superimposed on and directly communicating with the pump's inlet and outlet channels, respectively. The relief ports simultaneously communicate with an open mesh pumping chamber so as to provide an intermittent controlled leak from the open mesh pumping chamber. Upon rotation of the gear members of the gerotor pump when the volume in the open mesh pumping chamber is increasing to a maximum volume, fluid in the open mesh pumping chamber vents into the relief port superimposed on and communicating with the outlet channel while continuing to communicate with the relief port superimposed on and communicating with the inlet channel. Upon further rotation of the gear member when the volume in the open mesh pumping is decreasing, fluid in the open mesh pumping chamber is prevented from venting into the relief port superimposed and communicating with the inlet channel while continuing to communicate with the relief port superimposed on and communicating with the outlet channel. Thus, fluid over-pressure in an excessive fluid leakage from the open mesh pumping chamber is limited.

20 Claims, 2 Drawing Sheets

GEROTOR PUMP HAVING INLET AND OUTLET RELIEF PORTS

FIELD OF THE INVENTION

This invention relates to gerotor pumps, and more particularly, to pressure relief ports in gerotor pumps.

BACKGROUND OF THE INVENTION

Gerotor type hydraulic pumps typically include internally toothed and externally toothed gear members rotatably disposed within a pump housing. The teeth on the respective gears cooperate to define a plurality of variable volume pumping cheers whereupon during rotation of the gear members, a pumping chamber increases in volume to a maximum volume, then decreases in volume. Fluid from the pump's low pressure inlet port is drawn into pumping chambers that are increasing in volume. Upon further rotation of the gerotor when the pumping chambers are decreasing in volume, the fluid is pushed out through the pump's outlet port at a higher pressure. Because of the incompressibility of the fluid being pumped, when a certain pumping chamber is between the inlet and outlet ports (open mesh) and begins to decrease in volume, a situation known as "deadlock" or "hydrostatic lock" occurs. Deadlock or hydrostatic lock may cause the torque necessary to drive the gerotor pump to increase dramatically, thereby resulting in pumping losses, reduced pumping efficiency and increased pump noise.

Prior art devices have overcome the problem of deadlock or hydrostatic lock by incorporating relief ports which communicate with the pumping chamber to relieve the pressure therein. U.S. Pat. No. 3,034,448 ('448) discloses a gerotor pump having such relief ports. A trapping relief groove 71 extends 180° in the pump housing to communicate between a low pressure pumping chamber and a high pressure pumping chamber. The relief groove 71 does not, however, communicate with the inlet or outlet ports. To compensate for pump-to-pump variability in the actual position of the maximum and minimum volume pumping chamber relative to the groove 71, the gerotor in '448 uses balance ports 70 which are larger than groove 71. That is, because the relative positions of the maximum volume (high pressure) pumping chamber and the minimum volume (low pressure) pumping chamber may be different than the nominal 180° in different gerotor pumps, the balance ports are used to compensate for this variability.

The inventors of the present invention have found certain disadvantages with this prior art device. For example, the design of the gerotor in '448 is undesirable because it provides a continual, uncontrolled and excessive leakage path between the high and low pressure pumping chambers. Thus, leakage occurs from the pumping chamber even at positions where deadlock or hydrostatic lock does not occur. The fluid which is relieved from the pumping chamber of the gerotor in '448 is never pumped out to the outlet because the relief groove and balance ports do not communicate with the outlet port. Excessive leakage which is not directed to the outlet is undesirable because the pumping efficiency is decreased. That is, pumping energy is wasted in '448 because the fluid relieved from the pumping chamber is not utilized, but merely shuttled between high and low pressure pumping chambers. In addition, the width of groove 71 together with the location of the balance ports 70 must be tightly controlled to limit pump-to-pump variation of the volume of fluid leaking through groove 71. As a result, the relief port of '448 is a relatively complex design to manufacture and mass production may be compromised. Therefore, a need exist to relieve the pressure in the open mesh pumping chamber yet prevent excessive or uncontrolled leaking from the open mesh pumping chamber while maintaining relatively high pumping efficiency and consistency between mass-produced pumps.

SUMMARY OF THE INVENTION

An object of the present invention is to provide a gerotor pump having relief ports which intermittently communicate with the open mesh pumping chamber so as to relieve over-pressure in the open mesh pumping chamber and reduce excessive leakage from the open mesh pumping chamber. This object is achieved and disadvantages of prior art approached are overcome by providing a novel gerotor pump. In one particular aspect of the invention, the gerotor pump includes a pump housing, an internally toothed gear member rotatably disposed within the pump housing, and an externally tooth gear member rotatably disposed within the pump housing. The externally toothed gear cooperates with the internally toothed gear member to define a plurality of variable volume pumping chambers whereupon during rotation of the gear members, a pumping chamber increases in volume to a maximum volume, then decreases in volume. A generally arcuate inlet channel is formed in the pump housing and communicates exclusively with pumping chambers that are increasing in volume. A generally arcuate outlet channel is formed in the pump housing and communicates exclusively with pumping chambers that are decreasing in volume. The inlet and outlet channels are separated such that the channels are prevented from simultaneously communicating with an open mesh pumping chamber. A pair of relief ports are superimposed on and directly communicate respectively with the inlet and outlet channels. The relief ports simultaneously communicate with the open mesh pumping chamber so as to provide an intermittent controlled leak from the open mesh pumping chamber. Upon rotation of the gear members when the volume in the open mesh pumping chamber is increasing to a maximum volume, fluid in the open mesh pumping chamber vents into the relief port superimposed on and communicating with the outlet channel while continuing to communicate with the relief port superimposed on and communicating with the inlet channel. Upon further rotation of the gear members when the volume in the open mesh pumping chamber is decreasing, fluid in the open mesh pumping chamber is prevented from venting into the relief port superimposed on and communicating with the inlet channel while continuing to communicate with the relief port superimposed on and communicating with the outlet channel. Fluid pressure in and excessive fluid leakage from the open mesh pumping chamber is therefore limited.

An advantage of the present invention is that fluid overpressure in the open mesh pumping chamber of the gerotor pump is reduced.

Another advantage of the present invention is that fluid leakage from the open mesh pumping chamber is controlled.

Still another advantage of the present invention is that an easy to manufacture gerotor pump having limited pump-to-pump variability is provided.

Yet another advantage of the present invention is that a gerotor pump having a relatively high pumping efficiency is provided.

Other objects, features and advantages of the present invention will be readily appreciated by the reader of this specification.

BRIEF DESCRIPTION OF THE DRAWINGS

The invention will now be described, by way of example, with reference to the accompany drawings, in which.

DETAILED DESCRIPTION OF THE PREFERRED EMBODIMENT

Figure 1:
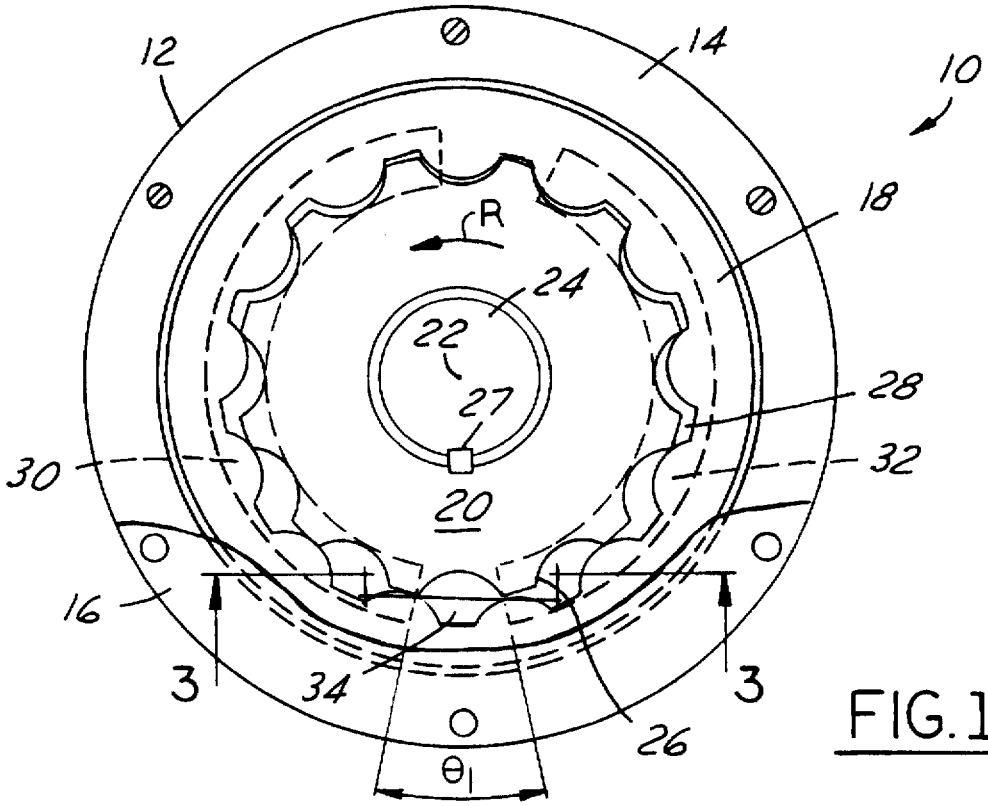
FIG. 1 is a diagrammatic representation of a gerotor pump according to the present invention.
Figure 2:
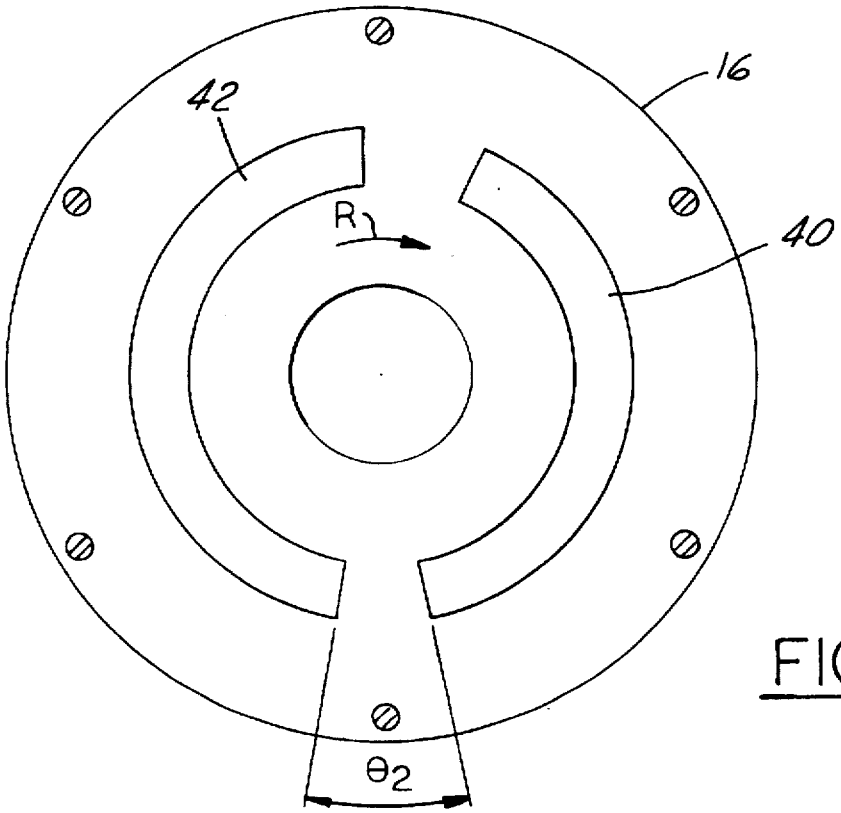
FIG. 2 is a plan view of the cover to the gerotor pump according to the present invention.
Figure 3:
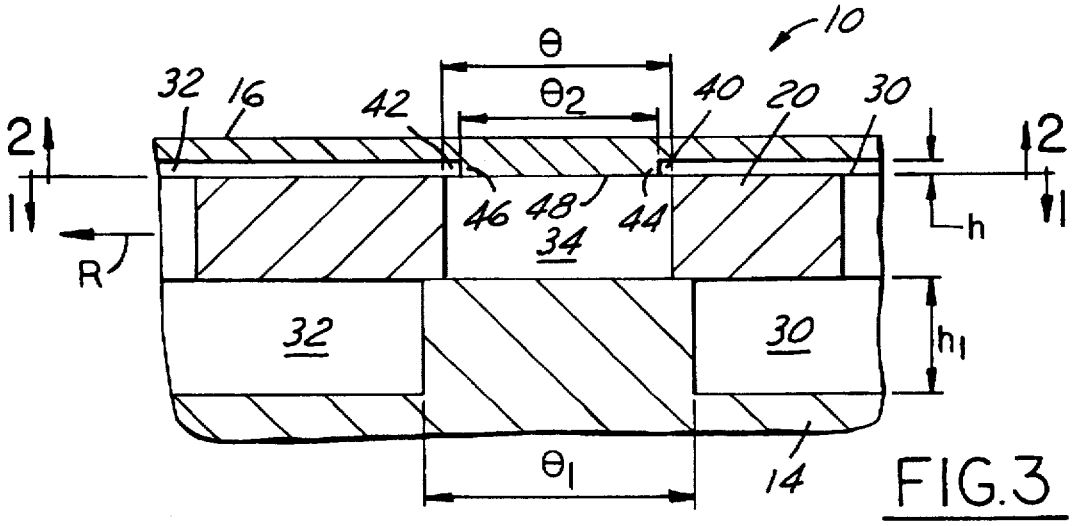
FIG. 3 is cross-section view of the gerotor pump taken along line 3—3 of FIG. 1; and, FIGS. 4 and 5 are alternative embodiments of the present invention.

Referring to the Figures, and in particular to FIGS. 1–3, gerotor pump 10 includes pump housing 12, having pump body 14 and pump cover 16, and internally and externally toothed gear members 18, 20, each having a plurality of teeth 26, disposed within housing 12. Externally toothed gear member 20 is supported for rotation on axis 22 of shaft 24 and keyed thereto by key 27 fitting into respective keyways on gear 20 and shaft 22. internally toothed gear member 18 is supported for rotation about an axis which is spaced from axis 22 so as to provide the necessary gear eccentricity for proper operation of gerotor pump 10. In addition, externally toothed gear member 20 has one less tooth 26 than that of internally tooth gear member 18. Teeth 26 on the respective gears cooperate to define a plurality of variable volume pumping chambers 28 whereupon during rotation of gear members 18, 20, a pumping chamber 28 increases in volume to a maximum volume, then decreases in volume.

Pump housing 12 also includes arcuately shaped inlet and outlet channels 30, 32 formed in pump body 14. Inlet channel 30 communicates exclusively with pumping chambers 28 that are increasing in volume and outlet channel 32 communicates exclusively with pumping chambers 28 that are decreasing in volume. Accordingly, as gear members 18, 20 rotate in the direction shown as "R", fluid is drawn in through inlet channel 30 by the action of the increasing volume pumping chambers 28 and is pumped out through outlet channel 32 at a higher pressure by the action of the decreasing pumping chambers 28.

According to the present invention, inlet and outlet channels 30, 32 are prevented from simultaneously communicating with an open mesh pumping chamber 34, which is near a maximum volume. That is, as the fluid transitions from the low pressure inlet channel 30 to the high pressure outlet channel 32, the fluid in the open mesh pumping chamber 34 is prevented from directly communicating with either the inlet or outlet channels 30, 32. To accomplish this, in the embodiment described herein, inlet and outlet channels 30, 32 are separated by an angle, shown as $\theta_1$, which is between about 100% and about 120% of a nominal separation angle $\theta$ (see FIG. 3). This nominal separation angle $\theta$ is defined by 360° divided by the number of teeth 26 on externally toothed gear member 20 and represents the angle when the open mesh pumping chamber 34 is at maximum volume. For example, suppose externally toothed gear member 20 has ten teeth. The nominal separation angle $\theta$ would be 36°. Thus, the separation angle $\theta_1$ separating inlet and outlet channels 30, 32 would be between about 36° and about 43.2°, which represents between about 100% and about 120% of the nominal separation angle $\theta$.

Referring now in particular to FIG. 2, cover 16 of pump housing 12 is shown such that the surface shown faces gear members 18, 20. That is, to assemble cover 16, shown in FIG. 2, to pump body 14, shown in FIG. 1, cover 16 must be turned over and placed on top of pump body 14. According to the present invention, cover 16 is formed with a pair of arcuately shaped relief ports 40, 42 and are positioned in cover 16 so as to be superimposed on and directly communicate with inlet and outlet channels 30, 32, respectively when cover 16 is assembled to pump body 14. Thus, relief ports 40, 42 arcuately extend from inlet and outlet channels 30, 32 and are separated by an angle $\theta_2$, which is between about 80% and about 95% of the nominal separation angle $\theta$ as earlier defined. Accordingly, $\theta_2$ ranges between about 28.8° and about 34.2° when the number of teeth on externally toothed gear member 20 is ten.

Turning now in particular to FIG. 3, which is a diagrammatic cross-section of gerotor 10, because the separation angle $\theta_2$ separating relief ports 40, 42 is smaller than the separation angle $\theta_1$ separating inlet and outlet channels 30, 32, relief ports 40, 42 communicate with the open mesh pumping chamber 34 so as to provide an intermittent controlled leak from the open mesh pumping chamber 34. As a result, upon rotation of gear members 18, 22, when the volume in the open mesh pumping chamber 34 is increasing to the maximum volume, fluid in the open mesh pumping chamber 34 vents into relief port 42 superimposed on and communicating with outlet channel 32 while continuing to communicate with relief port 40 superimposed on and communicating with inlet channel 30. Upon further rotation of gear members 18, 20 when the volume in the open mesh pumping chamber 34 is decreasing, fluid in the open mesh pumping chamber 34 is prevented from venting into relief port 40 superimposed on and communicating with inlet port 30 while continuing to communicate with relief port 42 superimposed on and communicating with outlet channel 32. Thus, fluid over-pressure in and excessive fluid leakage from the open mesh pumping chamber 34 is limited. As shown in FIG. 3, edges 44, 46 of relief ports 40, 42, respectively have an infinite slope relative to plane 48 of cover 16. Those skilled in the art will recognize in view of this disclosure that edges 44, 46 may have a gradual slope. Indeed, edges 44, 46 may be a fillet or the like.

To further limit the amount of over-pressure in the open mesh pumping chamber 34 yet control leakage from the open mesh pumping chamber 34, relief ports 40, 42 extend a depth "h", shown in FIG. 3, into pump cover 16 of about 5% to about 15% of the combined depth "h"+"$h_1$", where "$h_1$" represents the depth of the inlet and outlet channels 30, 32. Thus, the depth "h" of relief ports 40, 42 is controlled so as to act as a flow orifice limiting over-pressure and excessive leakage as previously described. In a preferred embodiment, the depth "h" is preferably about 1 millimeter. This allows for an easily manufacturable pump cover 16 in that pump cover 16 may be stamped from plate steel, with relief ports 40, 42 stamped directly therein.

Because relief ports 40, 42 are superimposed on inlet and outlet channels 30, 32, respectively, relief ports 30, 32 may be considered as comprising a portion of inlet and outlet channels 30, 32. As such, inlet and outlet channels 30, 32 may be considered to be stepped such that the each channel has a main flow portion for handling the inlet and outlet flows as well as a pressure relief portion for relieving pressure in the open mesh pumping chamber 34 yet controlling leakage therefrom.

According to the present invention, two relief ports 40, 42 are formed within housing 12 so as to be superimposed on inlet and outlet ports 30, 32, respectively. By utilizing two relief ports 40, 42, a less controlled manufacturing tolerance is necessary. That is, suppose gerotor pump 10 is provided with only relief port 42, the point at which open mesh pumping chamber 34 begins to communicate with relief port 42 must be precisely controlled. With two relief ports 40, 42, the point at which open mesh pumping chamber 34 begins to communicate with relief port 42 need not be precisely controlled because venting will occur into relief port 40 should the volume in the open mesh pumping chamber begin to decrease prior to communicating with relief port 42. In addition, pressure fluctuations in the open mesh pumping chamber 34 may be limited with two, relatively shallow relief ports 40, 42 rather than one, relatively deeper relief port 42. Moreover, two relief ports 40, 42 have the added benefit of reducing inlet port flow velocity, which may otherwise tend to produce cavitation of the fluid flowing therethrough.

Figure 4:
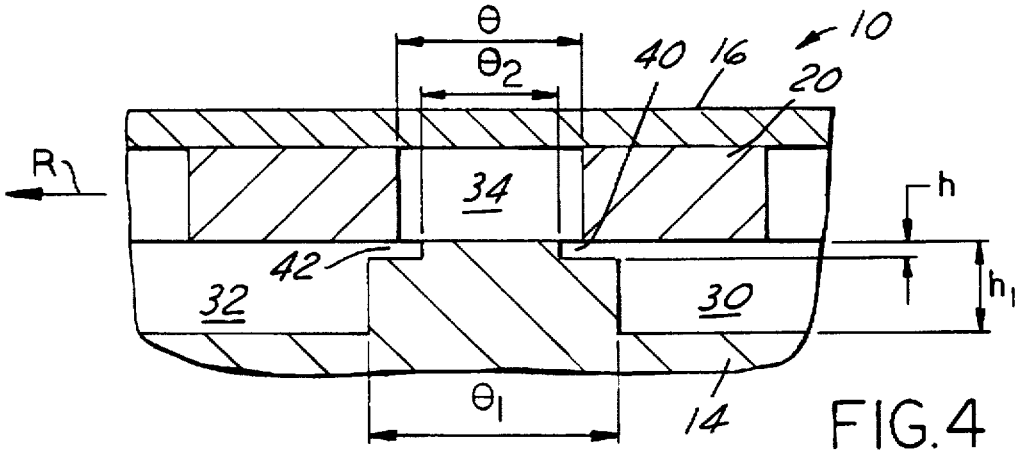

Turning now to FIG. 4, an alternative embodiment according to the present invention is shown. Here, relief ports 40 and 42 are formed in pump body 14, rather than in cover 16, and arcuately extend from inlet and outlet channels 30, 32, respectively. As discussed with reference to FIG. 3, inlet and outlet channels 30, 32 are separated by an angle $\theta_1$, which is between about 100% and about 120% of the nominal separation angle $\theta$, and relief ports 40, 42 are separated by an angle $\theta_2$, which is between about 80% and about 95% of the nominal separation angle $\theta$. Because $\theta_2$ is less than $\theta_1$, relief ports 40, 42 communicate with the open mesh pumping chamber 34 so as to provide an intermittent controlled leak from the open mesh pumping chamber 34. As described with reference to FIGS. 1–3, upon rotation of gear members 18, 22, when the volume in the open mesh pumping chamber 34 is increasing to the maximum volume, fluid in the open mesh pumping chamber 34 vents into relief port 42 superimposed on and communicating with outlet channel 32 while continuing to communicate with relief port 40 superimposed on and communicating with inlet channel 30. Upon further rotation of gear members 18, 20 when the volume in the open mesh pumping chamber 34 is decreasing, fluid in the open mesh pumping chamber 34 is prevented from venting into relief port 40 superimposed on and communicating with inlet port 30 while continuing to communicate with relief port 42 superimposed on and communicating with outlet channel 32. Thus, fluid over-pressure in and excessive fluid leakage from the open mesh pumping chamber 34 is limited. In addition, to control the leakage from the open mesh pumping chamber 34, relief ports 40, 42 extend a depth "h" into pump body 14 between about 5% to about 15% of the combined depth "h"+"$h_1$", where "$h_1$" represents the depth of the inlet and outlet channels 30, 32.

Figure 5:
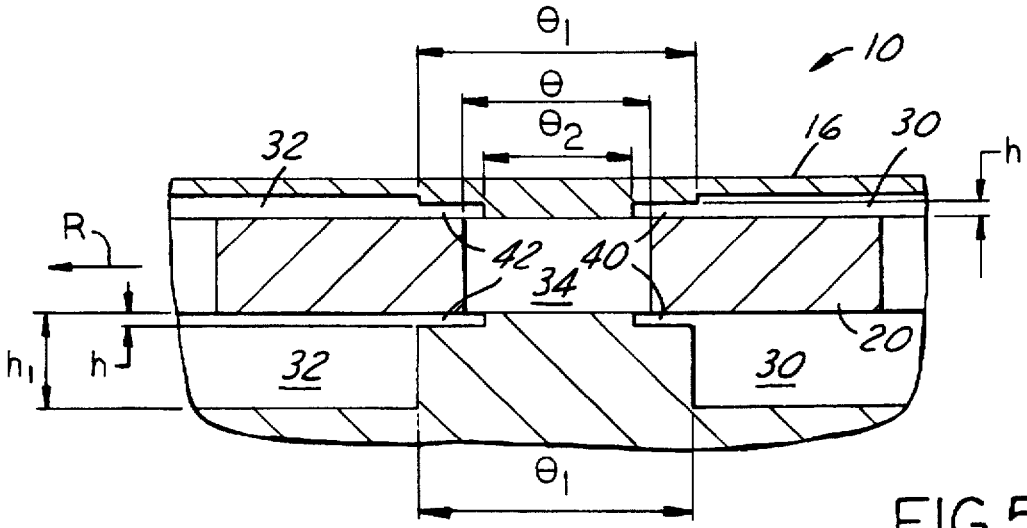

A further embodiment of the present invention is shown in FIG. 5. Here, relief ports 40, 42 are formed in both the pump body 14 and pump cover 16 and have the same dimensional relationships ($\theta$, $\theta_1$, $\theta_2$, "h" and "$h_1$") as that described with reference to FIGS. 1–4. In addition, inlet and outlet channels 30, 32 are also formed in pump body 14 and pump cover 16. This embodiment is preferred when handling higher flow rates and pressures.

While the best mode for carrying out the invention has been described in detail, those skilled in the art in which this invention relates will recognized various alternatives and embodiments, including those mentioned above, in practicing the invention that has been defined by the following claims.

We claim:

1. A gerotor pump for pumping fluids comprising:

a pump housing;

an internally toothed gear member rotatably disposed within said pump housing;

an externally toothed gear member rotatably disposed within said pump housing, with said externally toothed gear member cooperating with said internally toothed gear member to define a plurality of variable volume pumping chambers whereupon during rotation of said gear members, a pumping chamber increases in volume to a maximum volume then decreases in volume;

a generally arcuate inlet channel formed in said pump housing, with said inlet channel communicating exclusively with pumping chambers that are increasing in volume;

a generally arcuate outlet channel formed in said pump housing, with said outlet channel communicating exclusively with pumping chambers that are decreasing in volume, with said inlet and outlet channels being separated such that said channels are prevented from simultaneously communicating with an open mesh pumping chamber; and, a pair of relief ports superimposed on and directly communicating with said inlet and outlet channels respectively, with said relief ports simultaneously communicating with said open mesh pumping chamber so as to provide an intermittent controlled leak from said open mesh pumping chamber, whereby, upon rotation of said gear members when the volume in said open mesh pumping chamber is increasing to said maximum volume, fluid in said open mesh pumping chamber vents into said relief port superimposed on and communicating with said outlet channel while continuing to communicate with said relief port superimposed on and communicating with said inlet channel and, upon further rotation of said gear members when the volume in said open mesh pumping chamber is decreasing, fluid in said open mesh pumping chamber is prevented from venting into said relief port superimposed on and communicating with said inlet channel while continuing to communicate with said relief port superimposed on and communicating with said outlet channel, thereby limiting fluid over-pressure in and excessive fluid leakage from said open mesh pumping chamber.

2. A gerotor pump according to claim 1 wherein said inlet and said outlet channels are separated by an angle which is between about 100% and about 120% of a nominal separation angle, with said nominal separation angle being 360° divided by the number of teeth on said externally toothed gear member.

3. A gerotor pump according to claim 1 wherein said relief ports are separated from each other by an angle which is between about 80% and about 95% of a nominal separation angle, with said nominal separation angle being 360° divided by the number of teeth on said externally toothed gear member.

4. A gerotor pump according to claim 1 wherein said housing comprises a pump body and a pump cover, with said inlet and said outlet channels being formed in said pump body and with said relief ports being formed in said pump cover.

5. A gerotor pump according to claim 1 wherein said housing comprises a pump body and a pump cover, with said inlet channel, said outlet channel and said relief ports being formed in said pump body.

6. A gerotor pump according to claim 1 wherein said housing comprises a pump body and a pump cover, with said inlet and said outlet channels being formed in said pump body and with said relief ports being formed in both said pump body and said pump cover.

7. A gerotor pump according to claim 1 wherein said relief ports have a depth of about 5% to about 15% of the combined depth of said relief ports and said channels.

8. A gerotor pump according to claim 1 wherein said relief ports comprise a portion of each said channel, respectively.

9. A gerotor pump comprising:

a pump housing;

an internally toothed gear member rotatably disposed within said pump housing;

an externally toothed gear member rotatably disposed within said pump housing, with said externally toothed gear member cooperating with said internally toothed gear member to define a plurality of variable volume pumping chambers whereupon during rotation of said gear members, a pumping chamber increases in volume to a maximum volume then decreases in volume;

a stepped inlet channel formed in said pump housing, with said stepped inlet channel having an inlet flow port and an inlet relief port superimposed on said inlet port, with said inlet flow port communicating exclusively with pumping chambers that are increasing in volume;

a stepped outlet channel formed in said pump housing, with said stepped outlet channel having an outlet flow port and an outlet relief port superimposed on said outlet port, with said outlet flow port communicating exclusively with pumping chambers that are decreasing in volume; and, with said inlet and outlet flow ports being separated such that said inlet and outlet flow ports are prevented from simultaneously communicating with an open mesh pumping chamber and with said inlet and outlet relief ports simultaneously communicating with said open mesh pumping chamber so as to provide an intermittent controlled leak from said open mesh pumping chamber, whereby, upon rotation of said gear members when the volume in said open mesh pumping chamber is increasing to said maximum volume, fluid in said open mesh pumping chamber vents into said outlet relief port while continuing to communicate with said inlet relief port and, upon further rotation of said gear members when the volume in said open mesh pumping chamber is decreasing, fluid in said open mesh pumping chamber is prevented from venting into said inlet relief port while continuing to communicate with said outlet relief port, thereby limiting fluid over-pressure in and excessive fluid leakage from said open mesh pumping chamber.

10. A gerotor pump according to claim 9 wherein said inlet and outlet flow ports are separated by an angle which is between about 100% and about 120% of a nominal separation angle, with said nominal separation angle being 360° divided by the number of teeth on said externally toothed gear member.

11. A gerotor pump according to claim 9 wherein said inlet and outlet relief ports are separated by an angle which is between about 80% and about 95% of a nominal separation angle, with said nominal separation angle being 360° divided by the number of teeth on said externally toothed gear member.

12. A gerotor pump according to claim 9 wherein said housing comprises a pump body and a pump cover, with said inlet and outlet flow ports being formed in said pump body and with said inlet and outlet relief ports being formed in said pump cover.

13. A gerotor pump according to claim 9 wherein said housing comprises a pump body and a pump cover, with said inlet and outlet channels being formed in said pump body.

14. A gerotor pump according to claim 9 wherein said housing comprises a pump body and a pump cover, with said inlet and outlet flow ports being formed in said pump body and with said inlet and outlet relief ports being formed in both said pump body and said pump cover.

15. A gerotor pump according to claim 9 wherein said inlet and outlet relief ports have a depth of about 5% to about 15% of the depth of combined depth of said relief ports and said inlet and outlet flow ports.

16. A gerotor pump according to claim 9 wherein said channels are generally arcuate in shape.

17. A gerotor pump for pumping oil through an internal combustion engine, with said gerotor comprising:

a pump housing;

an internally toothed gear member rotatably disposed within said pump housing;

an externally toothed gear member rotatably disposed within said pump housing, with said externally toothed gear member cooperating with said internally toothed gear member to define a plurality of variable volume pumping chambers whereupon during rotation of said gear members, a pumping chamber increases in volume to a maximum volume then decreases in volume;

generally arcuate inlet and outlet channels formed in said pump housing, with each said channel having a main flow portion and a relief portion arcuately extending from said main flow portion, with said relief portions providing an intermittent controlled leak between said main flow portions, whereby, upon rotation of said gear members when the volume in an open mesh pumping chamber is increasing to said maximum volume, fluid in said open mesh pumping chamber vents into said outlet channel relief port while continuing to communicate with said inlet channel relief port and, upon further rotation of said gear members when the volume in said open mesh pumping chamber is decreasing, fluid in said open mesh pumping chamber is prevented from venting into said inlet channel relief port while continuing to communicate with said outlet channel relief port, thereby limiting fluid over-pressure in and excessive fluid leakage from said open mesh pumping chamber.

18. A gerotor pump according to claim 17 wherein said main flow portions are separated by an angle which is between about 100% and about 120% of a nominal separation angle, with said nominal separation angle being 360° divided by the number of teeth on said externally toothed gear member.

19. A gerotor pump according to claim 17 wherein said relief portions are separated by an angle which is between about 80% and about 95% of a nominal separation angle, with said nominal separation angle being 360° divided by the number of teeth on said externally toothed gear member.

20. A gerotor pump according to claim 17 wherein said relief portions have a depth of about 5% to about 15% of the depth of the combined depth of said relief portions and said main flow portions.

* * * * *